United States Patent [19]

Yamabayashi et al.

[11] Patent Number: 4,688,514

[45] Date of Patent: Aug. 25, 1987

[54] BARREL-TYPE COATING APPARATUS

[75] Inventors: Sadayoshi Yamabayashi; Yuichi Iwaki, both of Uozu, Japan

[73] Assignee: Yoshida Kogyo K. K., Tokyo, Japan

[21] Appl. No.: 890,180

[22] Filed: Jul. 25, 1986

[30] Foreign Application Priority Data

Jul. 27, 1985 [JP] Japan ..... 60-166082

[51] Int. Cl.[4] ..... B05C 5/00

[52] U.S. Cl. ..... 118/64; 118/19; 118/20; 118/303

[58] Field of Search ..... 118/64, 20, 19, 303

[56] References Cited

U.S. PATENT DOCUMENTS

| | | | |
|---|---|---|---|
| 3,095,326 | 6/1963 | Green et al. | 118/19 X |
| 3,357,398 | 12/1967 | Gross | 118/20 X |
| 3,601,088 | 8/1971 | Lacam | 118/20 X |
| 3,874,092 | 4/1975 | Huttlin | 118/20 X |
| 4,311,111 | 1/1982 | Inaba | 118/56 |

FOREIGN PATENT DOCUMENTS 47-51453 12/1972 Japan .

*Primary Examiner*—John P. McIntosh

*Attorney, Agent, or Firm*—Hill, Van Santen, Steadman & Simpson

[57] ABSTRACT

A barrel-type coating apparatus includes a perforated barrel rotatably and pivotably mounted on a frame, and a cup-shaped heating chamber slidably supported on the frame and reciprocably movable toward and away from the barrel for removably receiving therein the barrel from an open end thereof while the barrel is held in an upwardly tilted position. The cup-shaped heating chamber includes a heater mounted thereon for heating the atmosphere in the heating chamber and a paint-spraying nozzle projecting into the interior of the heating chamber. With this construction, the barrel atmosphere is heated and cooled immediately after the barrel has been received in and removed from the hot atmosphere in the preheated heating chamber so that the paint-spraying, setting, baking and cooling steps can be carried out at a relatively short period of time. An open end of the heating chamber is directed vertically downwardly while the heating chamber is held in an elevated waiting position remote from the barrel, thereby preventing the hot atmosphere in the heating chamber from escaping from the heating chamber.

10 Claims, 12 Drawing Figures

BARREL-TYPE COATING APPARATUS

BACKGROUND OF THE INVENTION

1. Field of the Invention

The present invention relates to a barrel-type coating apparatus suitable for the bulk treatment of small parts such as sliders and end stops of slide fasteners, buttons, hook-and-eye fasteners, ornaments or the like.

2. Prior Art

A typical example of known coating apparatus of the type described is shown in FIG. 12 of the accompanying drawings. The apparatus includes a cup-like drum 13 pivotably supported on a frame 14 and normally held in an upwardly tilted position, a barrel 15 rotatably mounted in a drum 13, an exhaust duct 16 disposed above the drum 13, and a paint-spraying nozzle 17 and a hot-air blowing nozzle 18 which are disposed adjacent to an open end 19 of the drum 13. In operation, a batch of parts is put into the barrel 15 while being rotated, and paint is sprayed from the nozzle 17 onto the parts in the rotating barrel 15. The coated paint on the parts is set and baked by hot air blown from the nozzle 18 into the barrel 15. Then the hot air in the barrel 15 is expelled through the exhaust duct 16 to cool the baked paint on the parts. The barrel 15 is continuously rotated during the baking and cooling steps. Finally, the drum 13 is tilted downwardly to discharge the parts from the barrel 15.

With the apparatus thus constructed, all the paint-spraying, setting, baking and cooling steps are carried out in the drum 13, with the result that the barrel atmosphere must be expelled from the barrel 15 before the baking and cooling steps are started. Such construction causes a great loss of heat energy and requires a relatively long processing time, resulting in reduction of productivity.

SUMMARY OF THE INVENTION

It is accordingly an object of the present invention to provide an apparatus for coating batches of parts at an increased productivity rate without a substantial loss of heat energy.

According to the invention, an apparatus for coating batches of parts comprises a perforated barrel rotatably and pivotably mounted on a frame, and a cup-shaped heating chamber slidably supported on the frame and reciprocably movable toward and away from the barrel for removably receiving therein the barrel from an open end thereof while the barrel is held in an upwardly tilted position, the cup-shaped heating chamber including a heating means mounted thereon for heating the atmosphere in the heating chamber and a paint-spraying nozzle projecting into the interior of the heating chamber. With this construction, the barrel atmosphere is heated and cooled immediately after the barrel has been received in and removed from the hot atmosphere in the preheated heating chamber so that the paint-spraying, setting, baking and cooling steps can be carried out in a relatively short period of time. The cup-shaped heating chamber includes an open end directed downwardly while the heating chamber is held in an elevated waiting or stand by position remote from the barrel. With the open end thus directed, the hot atmosphere in the heating chamber, which tends to move upwardly, is unlikely to escape from the heating chamber. The coating apparatus thus constructed is capable of treating batches of parts at an increased rate of production without a substantial loss of heat energy. The heating chamber may have an oblique open end inclined downwardly toward a horizontal plane to reduce a heat loss while the heating chamber is in the elevated waiting position. Preferably, the heating chamber is pivotably supported on the frame and is held in a vertically suspended position with its open end directed vertically downwardly while the heating chamber is in the elevated waiting position.

Many other advantages, features and other objects of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
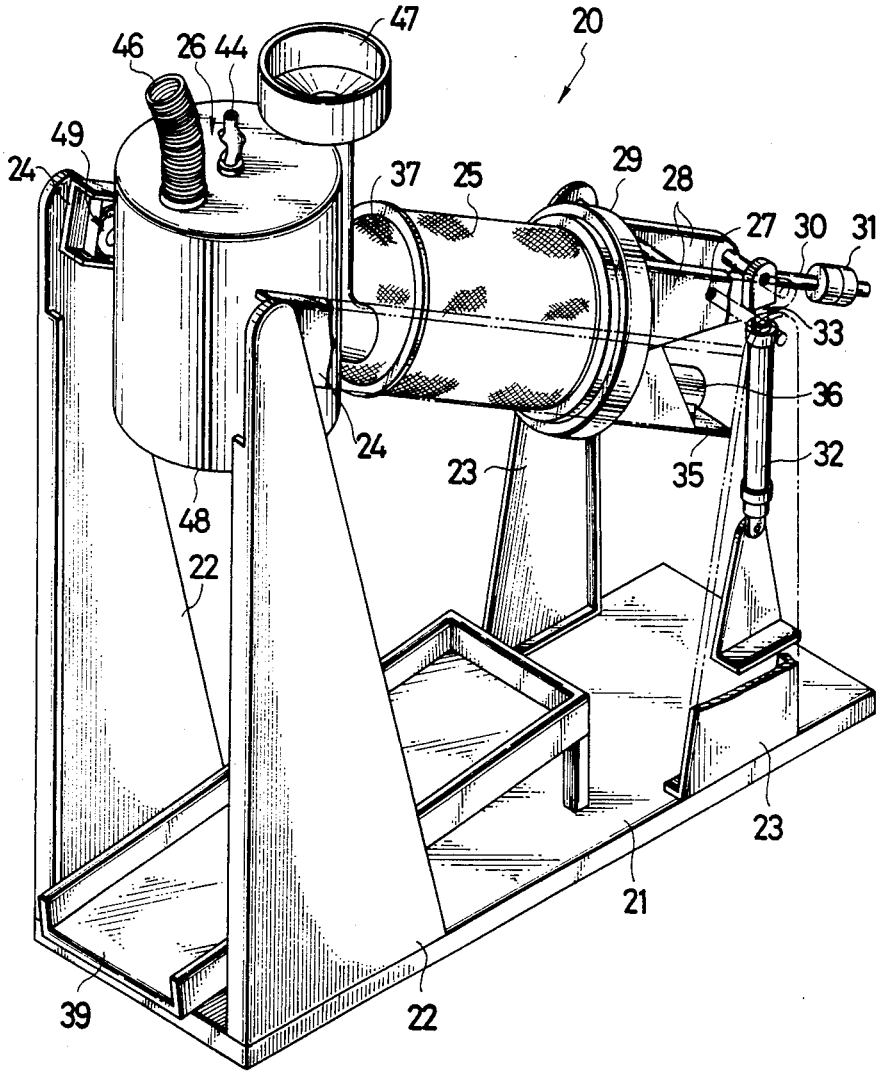
FIG. 1 is a schematic perspective view, with parts omitted for clarity, of a barrel-type coating apparatus embodying the present invention.
Figure 2:
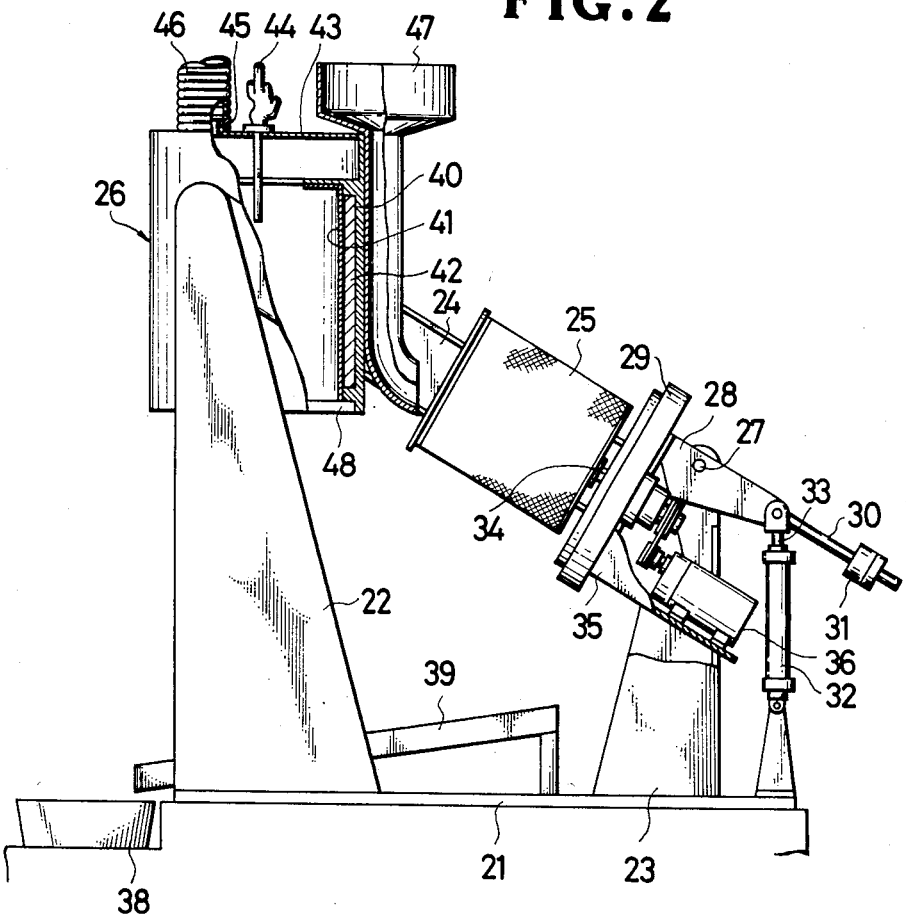
FIG. 2 is a schematic front elevational, partially cross-sectional view of the apparatus shown in FIG. 1.

As shown in FIGS. 1 and 2, a barrel-type coating apparatus 20 embodying the present invention comprises a rectangular base 21, a pair of front upright support plates 22, 22 disposed on opposite sides of the base 21 at one end thereof, a pair of rear upright support plates 23, 23 disposed on the opposite sides of the base 21 adjacent to the other end thereof, and a pair of guide rails 24, 24 extending between the front and rear upstanding support plates 22, 23, respectively. The front support plates 22 are higher than the rear support plates 23 so that the guide rails 24 incline downwardly from the front support plates 22 toward the rear support plates 23. The base 21, the front and rear support plates 22, 23 and the guide rails 24 jointly constitute a frame of the coating apparatus 20. The coating apparatus 20 further comprises a barrel 25 of wire mesh mounted on the frame adjacent to a lower end of the inclined guide rails 24, and a heating chamber 26 mounted on the frame adjacent to an upper end of the inclined guide rails 24.

The barrel 25 has a cup-like shape and includes a large number of small apertures or perforations in its peripheral wall. A pair of pivot arms 28 is pivotably supported on a crossbar 27 connected to and extending between upper ends of the rear support plates 23, 23. The pivot arms 28 are secured at their one ends to a circular attachment plate 29 at positions which are upwardly offset from the center of the circular attachment plate 29. A support rod 30 is connected to and projects from the other ends of the pivot levers 28 for supporting a balance weight or counterweight 31 on a distal end thereof. A clevis-type cylinder actuator 32 is pivotably mounted on the frame and includes a piston rod 33 pivotably connected to the other ends of the pivot arms 28. The barrel 25 is detachably connected at one end of a drive shaft 34 (FIG. 2) extending through a central hole (not shown) in the circular attachment plate 29 and journaled on the attachment plate 29. The other end of the drive shaft 34 is coupled in driven relation to an electric motor 36 via a suitable coupling means such as a chain-and-sprocket connection. The motor 36 is supported on a bracket 35 secured to the attachment plate 29 below the pivot arms 28. With this construction, the barrel 21 is rotatable about its own axis and, upon operation of the cylinder actuator 32, it is pivotably movable between an upwardly tilted position shown in FIGS. 1 and 2 where the axis of the barrel 25 is disposed centrally between and extends parallel to the guide rails 24, 24, and a downwardly tilted position shown in FIG. 11 for discharging parts P from the barrel 25 through an open end 37. The discharged parts P slide downwardly along a discharge chute 39 and then are collected in a tray or container 38 (FIG. 2).

The heating chamber 26 also has a cup-like shape and comprises, as shown in FIG. 2, an outer hollow cylindrical casing 40 and an inner hollow cylindrical casing 41 detachably mounted in the outer casing 40 with an annular heating means 42 such as a band heater or an oil heater, disposed between the inner and outer casings 41, 40. A paint-spraying nozzle 44 is mounted on an end wall 43 of the outer casing 40 and projects into the interior of the inner casing 41. An exchaust duct 45 is also connected to the end wall 43 and opens at one end thereof to the interior of the inner casing 41. The other end of the exhaust duct 45 is connected to one end of a flexible exhaust pipe 46 which is connected at its opposite end with an exhaust fan (not shown) for ventilating the heating chamber 26 to adjust the temperature of the room air or atmosphere in the heating chamber 26. The heating chamber 26 supports on its outer peripheral wall a loading chute 47 extending parallel to the axis of the heating chamber 26 for supplying parts P (FIG. 8) to be coated therethrough into the barrel 25.

The heating chamber 26 is pivotably supported on and between the guide rails 24, 24 and is angularly movable between a vertically suspended position (FIGS. 1, 2, 8 and 11) where an open end 48 of the heating chamber 26 faces downwardly toward the base 21, and a downwardly tilted position (FIGS. 9 and 10) where the axis of the heating chamber 26 extends parallel to the guide rails 24. The heating chamber 26, while being held in its downwardly tilted position, is also reciprocable along the guide rails 24 between an elevated waiting position (FIG. 9) remote from the barrel 25, and a lower processing position (FIG. 10) where the heating chamber 26 sealingly engages the attachment plate 29 to thereby surround the barrel 25. Such tilting and reciprocating movement of the heating chamber 26 is achieved by a drive mechanism 49 shown in FIGS. 3 through 5.

The drive mechanism 49 comprises a pair of parallel guide rods 50, 50 mounted on and extending longitudinally along each of the guide rails 24, 24, and a slider 51 slidably mounted on the pair of guide rods 50, 50. The slider 51 includes a rotary shaft 52 projecting therefrom in perpendicular relation to the guide rods 50, 50 and fixed at an outer end thereof to the heating chamber 26 at one side of the latter. The drive mechanism 49 also includes a pair of sprockets 53, 53 rotatably mounted on each guide rail 24 adjacent to opposite ends of the guide rods 50, 50, an endless chain 54 trained around the sprockets 53, 53 and connected to the slider 51, and a drive motor 55 (FIG. 3) coupled with one of the sprockets 53 supported on one guide rail 24, for running the chain 54 in opposite directions to reciprocate the slider 51 along the guide rods 50, 50. Due to a rigid connection between the shafts 52, 52 of the sliders 51, 51 and the heating chamber 26, both sliders 51, 51 are movable in unison upon rotation of the drive motor 55. The endless drive chain 54 on the other guide rail 24 may be omitted.

Figure 5:
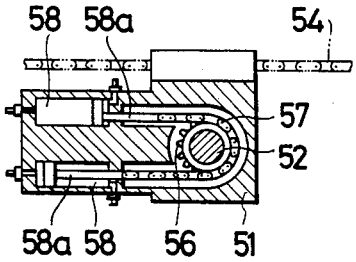
FIG. 5 is a cross-sectional view of a slider in the drive mechanism.

As shown in FIG. 5, at least one of the sliders 51 includes a sprocket 56 rotatably disposed therein and secured to the rotary shaft 52 for corotation therewith, a drive chain 57 movably disposed in the slider 51 and held in mesh with the sprocket 56, and two vertically juxtaposed fluid-actuated cylinders 58, 58 formed integrally with the slider 51 and having respective piston rods **58*a*, 58*a* connected with the opposite ends of the drive chain 57. With this construction, the shaft 52 is turned in opposite directions upon alternate activation and de-activation of the cylinders 58, 58, thereby angularly moving the heating chamber 26** between the vertically suspended position and the downwardly tilted position.

Figure 3:
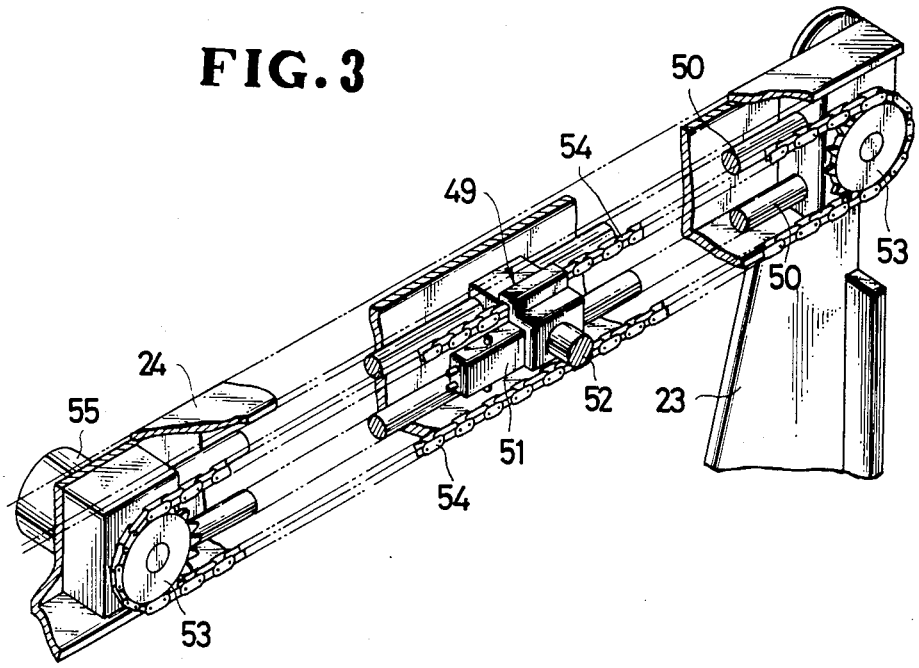
FIG. 3 is an enlarged fragmentary schematic perspective view, with parts cut away from brevity, of a drive mechanism for actuating a heating chamber of the apparatus.
Figure 4:
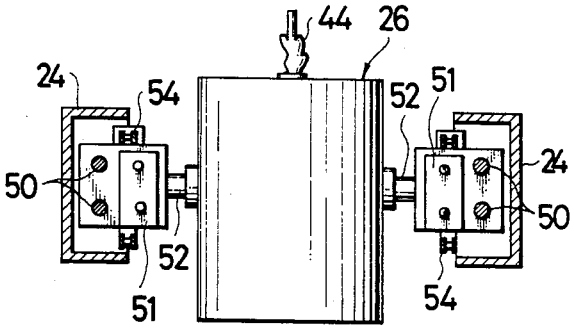
FIG. 4 is a transverse cross-sectional view of the drive mechanism.
Figure 6:
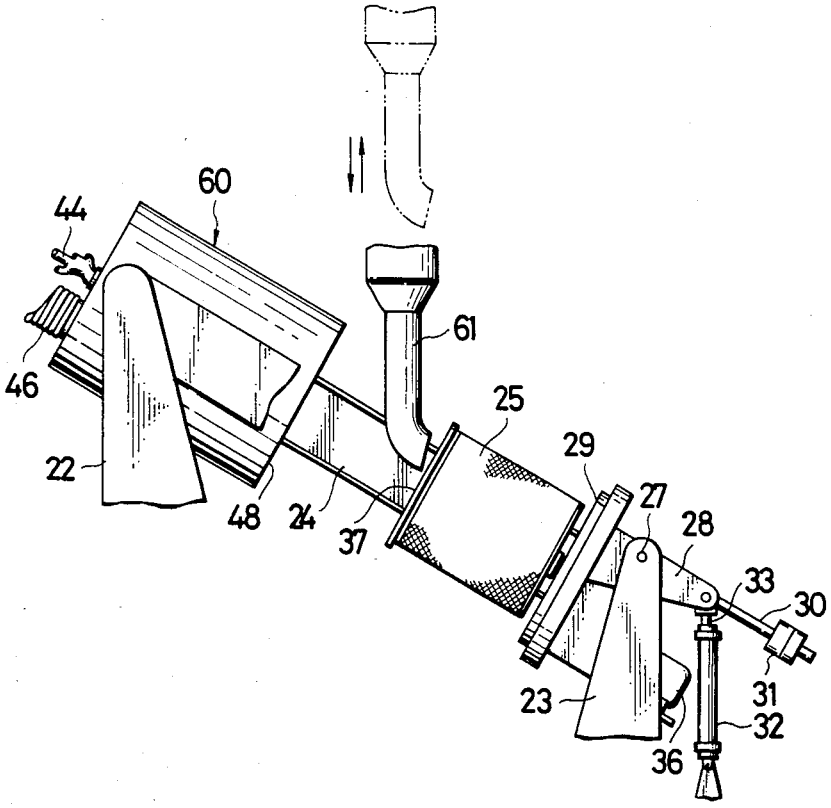
FIG. 6 is a fragmentary front elevational view of a modified coating apparatus.
Figure 7:
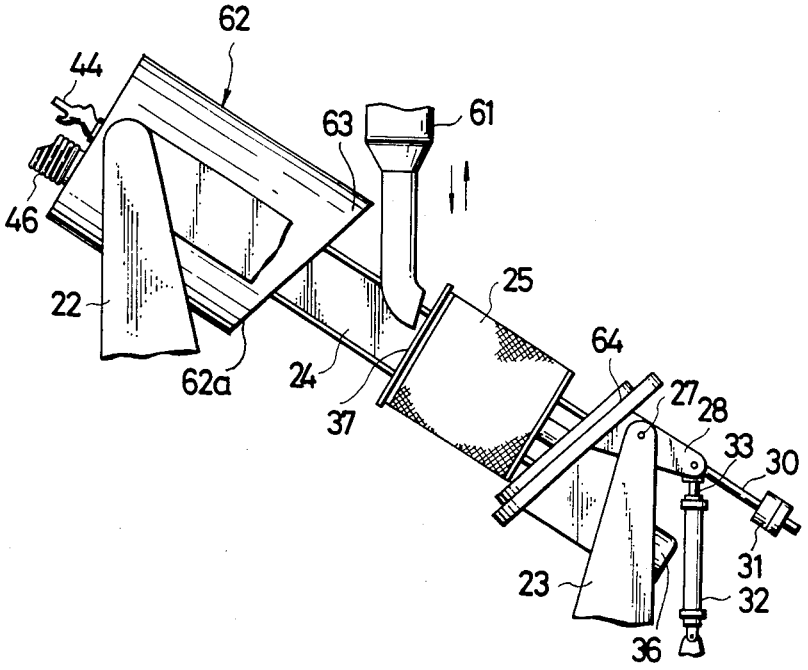
FIG. 7 is a view similar to FIG. 6, showing another modification according to the invention.

A modified coating apparatus shown in FIG. 6 is structually the same as the apparatus 20 shown in FIG. 1 with the exception that a heating-chamber driving mechanism does not include means for oscillating a heating chamber 60. Such reconstruction of the driving mechanism can readily be achieved by making the shaft 52 non-rotatable with respect to the slider 51 (FIGS. 3–5). Thus the heating chamber 60 is always held in the illustrated downwardly tilted postion and is only reciprocable toward and away from the barrel 25. The modified apparatus includes a loading chute 61 supported on the frame separately from the heating chamber 60 and vertically movable toward and away from the open end 37 of the barrel 25 for supplying a batch of parts to the barrel 25. With this construction, the open end 48 of the heating chamber 60 is directed obliquely downwardly while the heating chamber 60 is held in an elevated position remote from the barrel 25. The hot atmosphere in the heating chamber 60, which tends to move upwardly, is therefore prevented from escaping from the heating chamber 60. Thus hot atmosphere in the heating chamber 60 is maintained without a substantial loss of heat engergy FIG. 7 shows another modified apparatus which is similar to the apparatus shown in FIG. 6 but differs therefrom in that a heating chamber 62 has an oblique open end **62*a* inclined downwardly with respect to the axis of the heating chamber 62. The oblique open end 62*a* results from formation of an integral oblique hood portion 63 on the heating chamber 62. Another difference is in that a circular attachment plate 64 is also inclined downwardly away from the oblique hood portion 63 at the same angle of inclination as the oblique hood portion 63. With such oblique hood portion 63, heat loss in the heating chamber 62** is substantially eliminated.

The operation of the barrel-type coating apparatus 20 shown in FIG. 1 is described below with reference to FIGS. 8 through 11.

Figure 8:
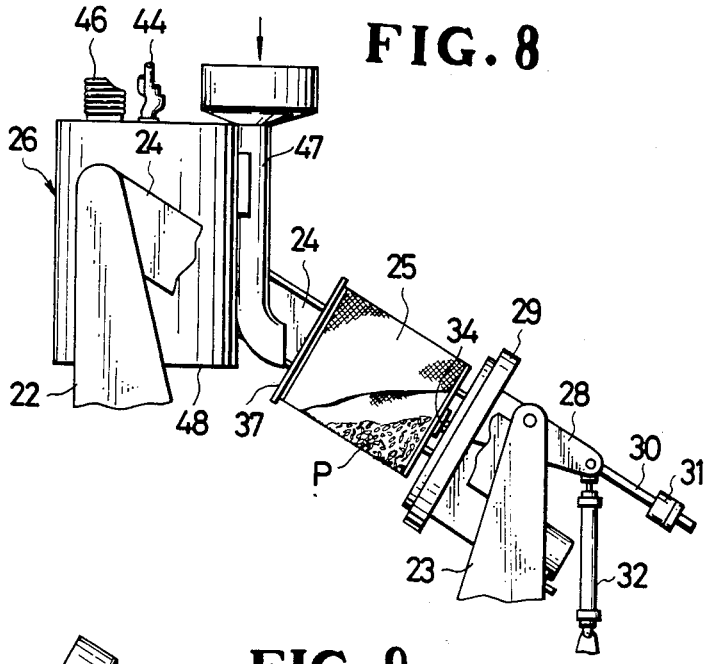
FIGS. 8 through 11 are diagrammatic fragmentary front elevational views showing successive steps of coating operation of the apparatus shown in FIG. 1.

As shown in FIG. 8, the heating chamber 26 is held in its elevated waiting position and is suspended vertically from the guide rails 24 with its open end 48 directed vertically downwardly. In this position, a lower discharge opening of the loading chute 47 is located ajacent to and faces toward the open end 37 of the barrel 25 which is held in the upwardly tilted position. The room air or the atmosphere in the heating chamber 26 is heated to a predetermined temperature by the heating means 42. Then a batch of parts P to be coated is supplied from the chute 47 into the barrel 25. The parts P are preferably preheated to a predetermined temperature for promoting prompt setting of the paint when the latter is sprayed onto the parts P.

Figure 9:
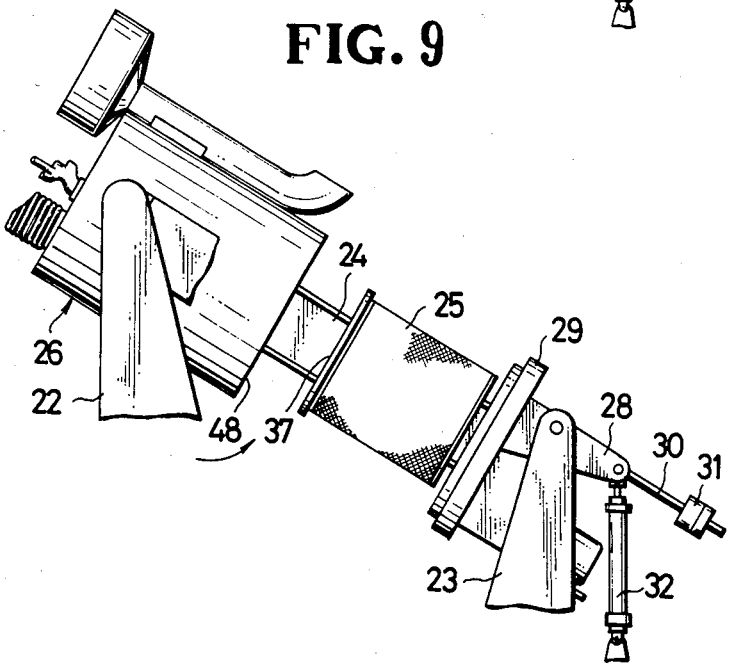

Then the cylinders 58, 58 (FIG. 5) are operated to angularly move the heating chamber 26 from the vertically suspended position of FIG. 8 to the downwardly tilted position of FIG. 9 where the heating chamber 26 is tilted at the same angle of inclination as the barrel 25 with its open end 48 facing toward the open end 37 of the barrel 25. Thereafter, the drive motor 55 (FIG. 3) is operated to move the sliders 51, 51 (FIG. 2) downwardly along the guide rods 50, 50 until the heating chamber 26 engages the circular attachment plate 29 to thereby encase the barrel 25 therein. Immediately thereafter the barrel 25 is heated to the same temperature as the hot atmosphere in the preheated heating chamber 26.

Figure 10:
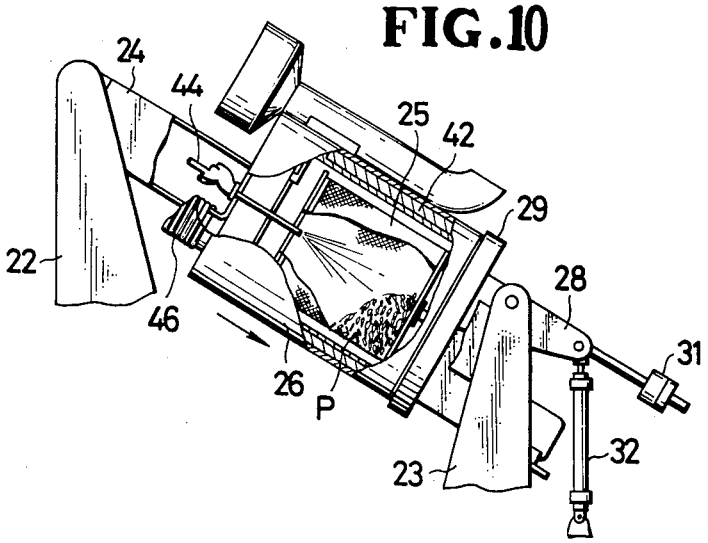

Thereafter, as shown in FIG. 10, the barrel 25 is rotated and paint is sprayed from the nozzle 44 onto the parts P in the rotating barrel 25. During that time, the atmosphere in the heating chamber 26 and hence the barrel atmosphere is maintained at the predetermined temperature by the heating means 42, so that the paint deposited on the parts P is immediately set and baked by the hot atmosphere in the heating chamber 26. These paint-spraying, setting and baking steps are continued until a coated paint layer of a predetermined thickness is provided on the parts P in the barrel 25 while being rotated.

Then the paint-spraying operation is ceased and the heating chamber 26 is moved upwardly away from the barrel 25 to the position of FIG. 9. The heating chamber 26 is then tilted to the vertically suspended position of FIG. 8 so that the hot atmosphere in the heating chamber 26 can be maintained without a substantial loss of heat energy. The barrel 25 is continuously rotated to cool the baked paint on the parts P, during which time cool air may be blown from a cool-air blower (not shown) onto the parts P to accelerate cooling of the baked paint.

Figure 11:
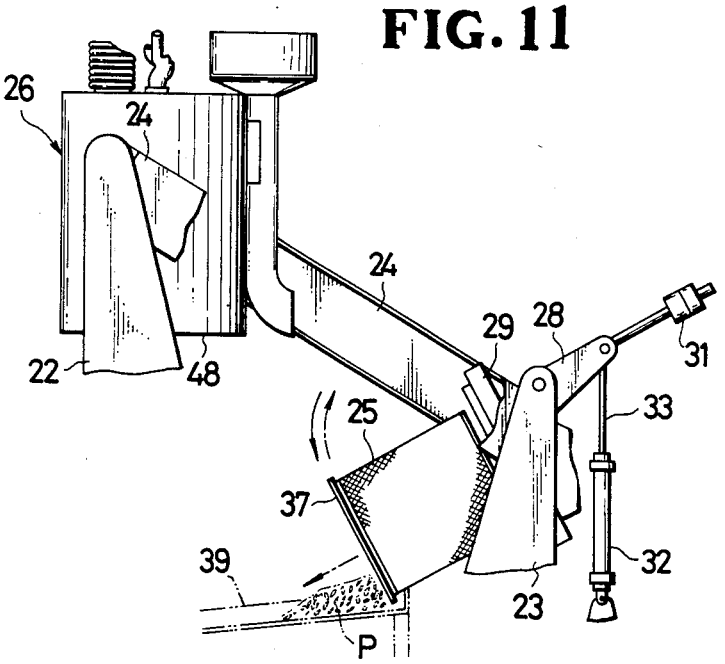
Figure 12:
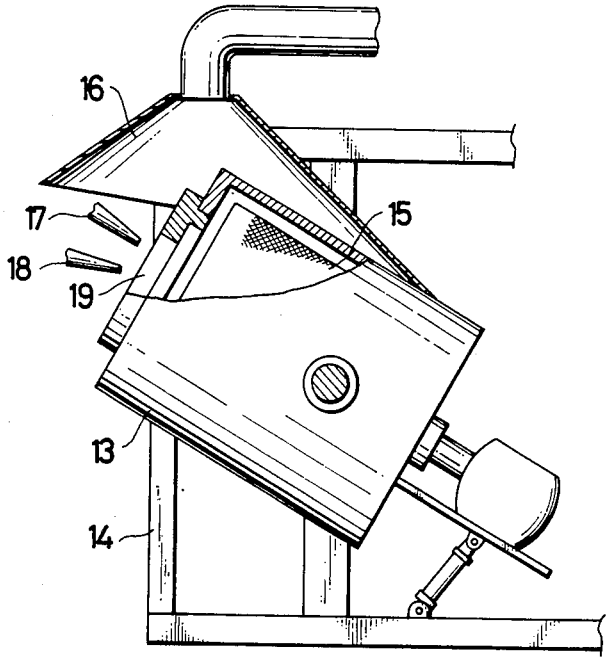
FIG. 12 (PRIOR ART)
FIG. 12 is a fragmentary front elevational, partially cross-sectional view of a known barrel-type coating apparatus.

Upon completion of the cooling step, the rotation of the barrel 25 is stopped and then the barrel 25 is tilted by the air cylinder 32 to move from the position of FIG. 8 to the downwardly tilted emptying position of FIG. 11 for discharging the coated parts P therefrom onto the chute 39. The discharged parts P slide downwardly along the chute 39 and then are collected in the container 38 (FIG. 2). Then the barrel 25 is returned to the upwardly tilted position for receiving the next batch of parts P to be treated therein.

The operation of the apparatus shown in FIGS. 6 and 7 is substantially the same as the foregoing operation of the apparatus 20 with the exception that each of the heating chambers 60, 62 is held in its elevated waiting position with the open end **48, 62*a* directed obliquely downwardly during the parts-supplying, cooling and discharging steps, and in that the loading chute 61 vertically reciprocates in timed relation to the reciprocating movement of the heating chamber 60, 62**.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for coating batches of parts comprising:

(a) a frame;

(b) a perforated barrel rotatably and pivotably mounted on said frame and angularly movable between an upwardly tilted position and a downwardly tilted position, said barrel having an open end;

(c) a cup-shaped heating chamber slidably supported on said frame and reciprocably movable between an elevated waiting position remote from said barrel and a lower processing position where said heating chamber fully receives therein said barrel from said open end thereof while said barrel is in said upwardly tilted position, said cup-shaped heating chamber having an open end directed downwardly while said heating chamber is in said elevated waiting position;

(d) heating means mounted on said heating chamber for heating the atmosphere in said heating chamber;

(e) a paint-spraying nozzle mounted on said heating chamber and projecting into the interior of said heating chamber; and (f) a drive mechanism supported on said frame and operatively connected with said heating chamber for reciprocating the latter.

2. An apparatus according to claim 1, further including a attachment plate pivotably and non-rotatably mounted on said frame, said barrel being rotatably mounted on said attachment plate, said attachment plate being engageable with said open end of said heating chamber to jointly encase said barrel in said heating chamber.

3. An apparatus according to claim 2, said open end of said heating chamber extending obliquely with respect to the axis of said cup-shaped heating chamber to face downwardly away from a closed end of said heating chamber, said attachment plate being inclined at the same angle of inclination as said oblique open end of said heating chamber.

4. An apparatus according to claim 1, further including a loading chute movably supported on said frame and reciprocably movable toward and away from said open end of said barrel, in timed relation to the reciprocating movement of said heating chamber, for supplying a batch of parts therefrom to said barrel.

5. An apparatus according to claim 1, said cup-shaped heating chamber including an outer hollow cylindrical casing and an inner hollow cylindrical casing detachably mounted in said outer casing, said heating means being disposed circumferentially between said outer and inner hollow cylindrical casings.

6. An apparatus according to claim 1, said frame including at least one inclined elongate guide rail extending obliquely along the axis of said barrel while the barrel is in said upwardly tilted position, said barrel being disposed adjacent to a lower end of said inclined guide rail, said drive mechanism including a slider slidably mounted on and reciprocably movable along said guide rail and means operatively connected with said slider for reciprocating the latter, said cup-shaped heating chamber being supported on said slider and held in a downwardly tilted position where said open end of said heating chamber faces toward the open end of said barrel while the barrel is in said upwardly tilted position.

7. An apparatus according to claim 6, said reciprocating means including a pair of sprockets rotatably mounted on opposite ends of said guide rail, an endless chain trained around said sprockets and connected with said slider, and an electric motor drivingly connected with one of said sprockets.

8. An apparatus according to claim 6, said heating chamber being pivotably connected with said slider, said drive mechanism further including means for oscillating said heating chamber between said downwardly tilted position and a vertically suspended position where said open end of said heating chamber is directed vertically downwardly.

9. An apparatus according to claim 8, said oscillating means comprising a shaft rotatably mounted on said slider and fixedly connected with said heating chamber, a sprocket rotatably disposed in said slider and secured to said shaft for corotation therewith, a drive chain movably disposed in said slider and held in mesh with said sprocket, and a pair of fluid-actuated cylinders formed integrally with said slider and operatively connected with opposite ends of said drive chain.

10. An apparatus according to claim 8, further including a loading chute mounted on said heating chamber and extending parallel to the axis of the latter for supplying a batch of parts therethrough to said barrel.

* * * * *